United States Patent [19]

Schultz

[11] Patent Number: 4,840,208

[45] Date of Patent: Jun. 20, 1989

[54] METHOD OF MANUFACTURING OBLONG WOODEN ARTICLES TO BE USED FOR THE MANUFACTURE OF COUPLED-TOGETHER PAIRS OF CHOPSTICKS

[75] Inventor: Gert Schultz, Hillerød, Denmark

[73] Assignee: Stormax International A/S, Herlev, Denmark

[21] Appl. No.: 166,080

[22] Filed: Mar. 9, 1988

[51] Int. Cl.[4] ..... B27M 1/08; B27L 5/02

[52] U.S. Cl. ..... 144/367; 144/1 R; 144/3 R; 144/369; 144/136 R; 83/40; 83/55; 83/56

[58] Field of Search ..... 144/3 R, 1 R, 367, 369, 144/371, 134 R; 83/40, 55, 56

[56] References Cited

U.S. PATENT DOCUMENTS 2,648,362 8/1953 Kopp ..... 144/369
3,716,086 2/1973 Barman ..... 144/369

*Primary Examiner*—W. Donald Bray

*Attorney, Agent, or Firm*—Pollock, Vande Sande & Priddy

[57] ABSTRACT

A method of manufacturing oblong wooden articles to be used for the manufacture of coherent pairs of chopsticks includes punching or cutting the articles out of veneer sheets along outer straight lines resulting in outer surfaces (6 and 7) being formed. These surfaces are preferably inclining slightly towards one another and extend over the entire length of the articles. The articles are simultaneously provided with a cut along the plane of symmetry between the inclining surfaces (6 and 7), which results in a short uncut portion at the thickest end (9). This cut (8) along the plane of symmetry extends only partially through the articles in the transverse direction thereof, whereby a bridge-creating portion (10) is present between the parts (2 and 3) of the articles. This bridge-creating portion (10) is optionally automatically removed at a succeeding processing involving a bevelling (11–18) of the parts of the article.

2 Claims, 1 Drawing Sheet

METHOD OF MANUFACTURING OBLONG WOODEN ARTICLES TO BE USED FOR THE MANUFACTURE OF COUPLED-TOGETHER PAIRS OF CHOPSTICKS

TECHNICAL FIELD

The invention relates to a method of manufacturing oblong wooden articles to be used for the manufacture of coherent pairs of chopsticks, whereby the oblong articles are punched and cut out of veneer sheets along outer straight lines resulting in outer surfaces being formed, said outer surfaces inclining slightly towards one another and extending over the entire length of the articles, and whereby each article is provided with a cut along the plane of symmetry between said outer surfaces leaving a short uncut portion at the thickest end. In the context of this application, a coherent pair of chopsticks refers to the two chopsticks of each pair of chopsticks being connected to one another.

BACKGROUND ART

It is generally known to manufacture oblong wooden articles to be used for the manufacture of coherent pairs of chopsticks. The articles are punched out of veneer sheets of a suitable wooden material and are processed into chopsticks by bevelling along all the longitudinal edges for instance by means of the apparatus described in Danish Patent Application No. 2564/86. In this apparatus the oblong articles are bevelled partly along outer longitudinal edges and partly along the edges abutting one another along the plane of symmetry. The bevelling is carried out from the thinnest to the thickest end of the chopsticks in such a manner that the two chopsticks have also been bevelled along the edges abutting the previously coherent portion when the uncut portion at the thickest end is broken. Previously the longitudinal cut in the plane of symmetry was completely through in the transverse direction, which, however, resulted in discarding of an unacceptable large number of articles before they reached the finishing process. The latter is due to the fact that the wooden material used for the manufacture of chopsticks has usually a relatively high moisture content, and the oblong articles must be subjected to a drying process before the finishing process, because said finishing process necessitates a relatively low moisture content, preferably approx. 15%. During the drying process the coherent portions of the oblong articles have a tendency to be mutually displaced at their free ends, which results in an unacceptable form of the articles, said form partly preventing a correct processing and partly making the finished chopsticks unsaleable.

SUMMARY OF THE INVENTION

The object of the invention is to provide a method for reducing the high waste of the oblong articles.

In satisfaction of the foregoing objects there is according to the invention provided a method, wherein the cut along the plane of symmetry extends only partially through the articles in the transverse direction thereof.

As a result oblong articles are provided where the two portions are coherent substantially in their entire length, whereby the ends are kept together during the drying process and thus prevented from moving relative to one another.

According to the invention it is particularly preferred that the cut along the plane of symmetry leaves an uncut portion of such a width that said portion is removed at the succeeding bevelling during the finishing process of the coherent pairs of chopsticks. In this manner the method used for avoiding the large waste of oblong articles does not involve extra price-raising steps in the finishing process.

BRIEF DESCRIPTION OF THE DRAWING

The invention is described below in greater details with reference to the accompanying drawing, in which.

DESCRIPTION OF PREFERRED EMBODIMENTS

Figure 1:
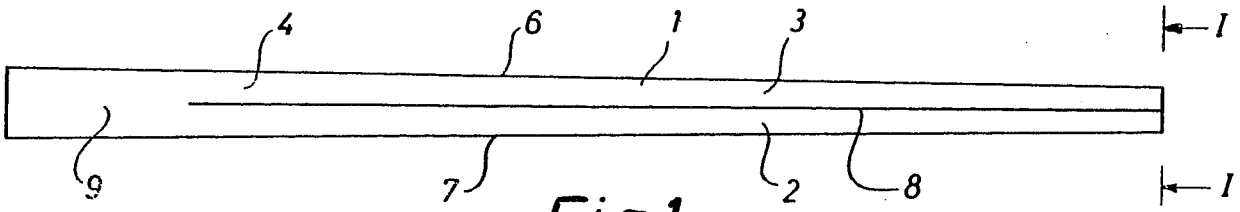
FIG. 1 is a top view of an article according to the invention.
Figure 2:
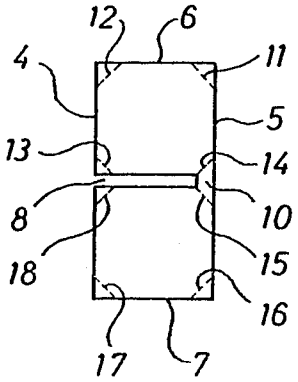
FIG. 2 is a view on a larger scale towards the thinnest end of the article of FIG. 1 taken along the line I—I of FIG. 1.

The article of FIGS. 1 and 2 comprises two oblong parts 2 and 3 defined on the outer side by two parallel surfaces 4 and 5 and two surfaces 6 and 7 inclining by the same inclination relative to a central plane of symmetry. The article 1 comprises furthermore a longitudinal slot 8 situated in the plane of symmetry between the two inclining surfaces 6 and 7, said slot being illustrated on a larger scale in FIG. 2 for the sake of clarity. This slot 8 extends from the thinnest end of the article over a considerable portion of the total length of said article, whereby only a short portion at the thickest end of the article is not covered by the slot 8. When seen in the longitudinal direction from one of the two parallel surfaces 4 and 5 the slot extends from one surface 4 to the immediate vicinity of the other surface 5 in such a manner that a short bridgecreating portion 10 is present between the two parts 2 and 3 of the article substantially everywhere along the slot 8.

At a succeeding processing of the article 1 in an apparatus for the manufacture of coherent pairs of chopsticks the parts 2 and 3 of the article are bevelled along all edges, preferably by means of milling cutter. The resulting bevelling is indicated by means of dotted lines 11–18 in FIG. 2. The bevellings 14 and 15 along the bridge-creating portion involve a removal of said portion, cf. FIG. 2, whereby the chopsticks manufactured are only coherent at the thickest end 9 in a manner known per se.

The article 1 is manufactured in a manner known per se by a punching out of veneer by means of blade-shaped knives cutting out the article along the inclining surfaces 6 and 7, the length of the article corresponding to the width of the veneer. Simultaneously with the punching out of the article along the inclining surfaces 6 and 7, the slot 8 is punched out by means of a knife preferably similar to the knife used for the manufacture of the surfaces 6 and 7, whereby said knife does not cut completely through during the punching process nor is it of the same length as the remaining two knives.

The article 1 may, however, also be manufactured in another manner, such as by a sawing process.

I claim:

1. A method of manufacturing oblong wooden articles to be used for the manufacture of coherent pairs of chopsticks, comprising the steps of:

punching and cutting the oblong articles out of veneer sheets along outer straight lines resulting in outer surfaces of the oblong articles being formed, said outer surfaces inclining slightly towards one another and extending over the entire length of the articles; and providing each article with a cut along the plane of symmetry between said outer surfaces and leaving a short uncut portion at the thickest end of the article, the cut along the plane of symmetry extending only partially through the article in the transverse direction thereof.

2. A method as in claim 1, wherein the cut along the plane of symmetry is provided in such an extension that an uncut portion is left having a width ensuring that said portion is removed by succeeding bevelling during the finishing process of the coherent pairs of chopsticks.

* * * * *